US006289640B1

(12) United States Patent
Ueda et al.

(10) Patent No.: US 6,289,640 B1
(45) Date of Patent: Sep. 18, 2001

(54) SEISMIC ISOLATION SLIDING SUPPORT BEARING SYSTEM

(75) Inventors: Sakae Ueda; Wakao Taguchi; Toshinao Kawai, all of Sanda (JP)

(73) Assignee: Nippon Pillar Packing Co., Ltd., Osaka (JP)

( * ) Notice: Subject to any disclaimer, the term of this patent is extended or adjusted under 35 U.S.C. 154(b) by 0 days.

(21) Appl. No.: 09/611,385

(22) Filed: Jul. 7, 2000

(30) Foreign Application Priority Data

Jul. 9, 1999 (JP) ..... 11-196355
Jul. 15, 1999 (JP) ..... 11-202276

(51) Int. Cl.[7] ..... E04H 9/02
(52) U.S. Cl. ..... 52/167.9; 52/167.4; 52/167.7
(58) Field of Search ..... 52/167.1, 167.4, 52/167.7, 167.9

(56) References Cited

U.S. PATENT DOCUMENTS 4,121,393 * 10/1978 Renault et al. ..... 52/167.7
4,152,799 * 5/1979 Koster et al. ..... 52/167.9 X
4,320,549 * 3/1982 Greb ..... 14/73.5
4,553,792 * 11/1985 Reeve ..... 52/167.1 X
4,554,767 * 11/1985 Ikonomou ..... 52/167.9
4,644,714 * 2/1987 Zayas ..... 52/167.4
5,669,189 * 9/1997 Logiadis et al. ..... 52/167.4
5,867,951 * 2/1999 Yaguchi et al. ..... 52/167.4

FOREIGN PATENT DOCUMENTS

001271346 * 6/1968 (DE) ..... 52/167.9
1513555 * 1/1968 (FR) ..... 52/167.9
401146042 * 6/1989 (JP) ..... 52/167.9
11124591 5/1999 (JP) .
001021718 * 6/1983 (SU) ..... 52/167.9

* cited by examiner

*Primary Examiner*—Beth A. Stephan
*Assistant Examiner*—Brian E. Glessner
(74) *Attorney, Agent, or Firm*—Webb Ziesenheim Logsdon Orkin & Hanson, P.C.

(57) ABSTRACT

The seismic isolation sliding support bearing system includes a pair of sliding bearings, which can be moved relatively to each other and are arranged in opposition and in contact with each other between a superstructure and a substructure. At least one of the pair of sliding bearings is a sliding bearing (a) made from a molding, having a porous structure including a plurality of voids, of a composition including PTFE as a main component and aromatic polyester resin, or a composite including a base member having the molding on the surface thereof. Furthermore, a lubricant holding layer for holding a flow lubricant in the voids is formed in a surface portion of the molding. Since the sliding bearing (a) has a high compression elastic modulus (of 900 MPa or more) and a low coefficient of friction (of 0.02 or less) and can maintain the low friction for a long period of time, it can be particularly effectively used in a seismic isolation sliding bearing support system for structures with a large load.

7 Claims, 3 Drawing Sheets

SEISMIC ISOLATION SLIDING SUPPORT BEARING SYSTEM

BACKGROUND OF THE INVENTION

1. Field of the Invention

The present invention relates to a seismic isolation sliding support bearing system with low friction.

2. Description of the Related Art

Seismic isolation sliding support bearing systems are widely used in general constructions including buildings and bridges, a variety of industrial products and industrial plants. A seismic isolation sliding support bearing system is provided between a superstructure of, for example, a building and a substructure corresponding to the foundation, and includes a pair of sliding bearings opposing and in contact with each other. When an earthquake occurs, these sliding bearings are displaced relatively to each other in spontaneous directions, so as to absorb the horizontal load. The seismic isolation sliding support bearing system functions in accordance with the following mechanism: When an earthquake occurs, a horizontal load is applied to the substructure. The horizontal load is reduced by the sliding function of the sliding bearings and transferred to the superstructure. The value of the horizontal load transferred to the superstructure can be obtained by multiplying the movable load of the superstructure with the coefficient of friction of the sliding bearings. Accordingly, it is desired that the sliding bearings have a low coefficient of friction.

Therefore, various propositions have been made for reducing the coefficient of friction between the sliding bearings of the seismic isolation sliding support bearing system. For example, one method that has been suggested is reducing the friction between the sliding bearings by applying a lubricant, such as grease and fluorinated oil, between the upper and lower sliding bearings. In the case where the lubricant is simply applied, however, the lubricant is soon lost from the space between the sliding bearings, and hence, the effect of the lubricant lasts for only a short period of time.

In order to overcome this disadvantage, fixation of the lubricant onto the surface of a metallic base plate of the sliding bearing has been proposed. For example, Japanese Laid-Open Patent Publication No. 11-124591 describes a seismic isolation sliding support bearing system using a sliding bearing made from a material obtained by causing a reaction, through heating, between polytetrafluoro ethylene resin (hereinafter referred to as PTFE), an epoxy resin and a reactive silicone oil having an epoxy group on a side chain.

Under application of a large load, however, the sliding bearing described in this publication poses the problem that a lubricating film fixed onto the metallic base plate by the functional group is eliminated from the sliding bearing through the sliding against the underlying PTFE at an early stage of the sliding. In addition, once the lubricating film is eliminated from the sliding bearing, it is necessary to form the film again, which disadvantageously requires a major operation such as jacking up the seismic isolation sliding support bearing system.

PTFE, which has low frictionality and good chemical stability, is preferably used as the material for sliding bearings, and can be used for providing a sliding bearing with promisingly low friction if the aforementioned problems can be solved. In the case where a sliding bearing made of PTFE including no filler is employed for the seismic isolation sliding support bearing system, sufficient seismic isolation cannot be attained in a multistoried building, a bridge or a three-storied house having a large movable load in which a surface pressure of, for example, 300 kgf/cm$^2$ or more is applied. This is because PTFE itself cannot attain high mechanical strength. In order to attain sufficient seismic isolation in such constructions having a large movable load, it generally accepted that the mechanical strength for attaining a compression elastic modulus of 900 MPa or more is necessary.

Moreover, the seismic isolation sliding support bearing system is desired to have a coefficient of friction that is low and stable for a long period of time as described above. In particular, if a permanent displacement is caused by an earthquake or the like, the shifting load required for restoration is smaller when coefficient of friction is lower. According to a test carried out by the present inventors, the coefficient of friction between sliding bearings made from PTFE including no filler is generally 0.05 through 0.15. When sliding is caused between these sliding bearings under application of a large surface pressure of 300 kgf/cm$^2$, the mechanical strength of the sliding bearings is so insufficient that the sliding bearings tend to degrade in a short period of time and loose their smooth sliding function.

Accordingly, there is a demand for a seismic isolation sliding support bearing system having high mechanical strength for attaining a compression elastic modulus of 900 MPa or more and a low coefficient of friction of 0.05 or less, which can be maintained for a long period of time.

SUMMARY OF THE INVENTION

The present invention relates to a seismic isolation sliding support bearing system comprising a pair of sliding bearings relatively movably opposing and in contact with each other between a superstructure and a substructure, wherein at least one of the sliding bearings is a sliding bearing (a) made from a molding, having a porous structure including plural voids, of a composition including PTFE as a main component and including aromatic polyester resin in a ratio of 14 through 35 wt %, and the molding includes, in a surface portion thereof, a lubricant holding layer where a flowable lubricant is held.

In a preferred embodiment, the composition used for forming the sliding bearing (a) includes at least one filler selected from the group consisting of graphite, glass fiber, molybdenum disulfide, potassium titanate and bronze.

In a preferred embodiment, the lubricant is a flowable polysiloxane.

In yet another preferred embodiment, the pair of sliding bearings are the sliding bearing (a) and a sliding bearing (b) made from a metallic base plate including, on a surface thereof, a resin film of a composition including tetrafluoroethylene as a main component, and the resin film of the sliding bearing (b) includes micropores having a diameter of 10 through 100 $\mu$m in an area ratio of 10 through 50%, and includes, in a surface portion thereof, a lubricant holding layer where a flowable lubricant is held.

In a more preferred embodiment, one of the pair of sliding bearings has a diameter smaller than the other.

In a further preferred embodiment, the sliding bearing (a) is smaller than the sliding bearing (b).

In a preferred embodiment, the seismic isolation sliding support bearing system has a coefficient of friction of 0.02 or less under a surface pressure of 200 kgf/m$^2$.

In this manner, according to the seismic isolation sliding support bearing system of this invention, owing to the sliding bearing (a) made from a molding or the like including PTFE having a porous structure and a high compression elastic modulus, a low coefficient of friction can be maintained for a medium or long period of time. As a result, the present seismic isolation sliding support bearing system can be suitably used in a wide range of fields including a seismic isolation sliding support bearing system for structures with a large load such as buildings and bridges.

In particular, when the diameter of the sliding bearing (a) made from the porous PTFE is smaller than the diameter of the other opposing sliding bearing, a sliding bearing (b) made from a metallic base plate having a porous PTFE film or a sliding bearing (c) made from a metallic base plate having a PTFE film, the seismic isolation sliding support bearing system can be free from a sliding failure, and early degradation and damage of the sliding bearings.

DESCRIPTION OF THE PREFERRED EMBODIMENT

Figure 1:
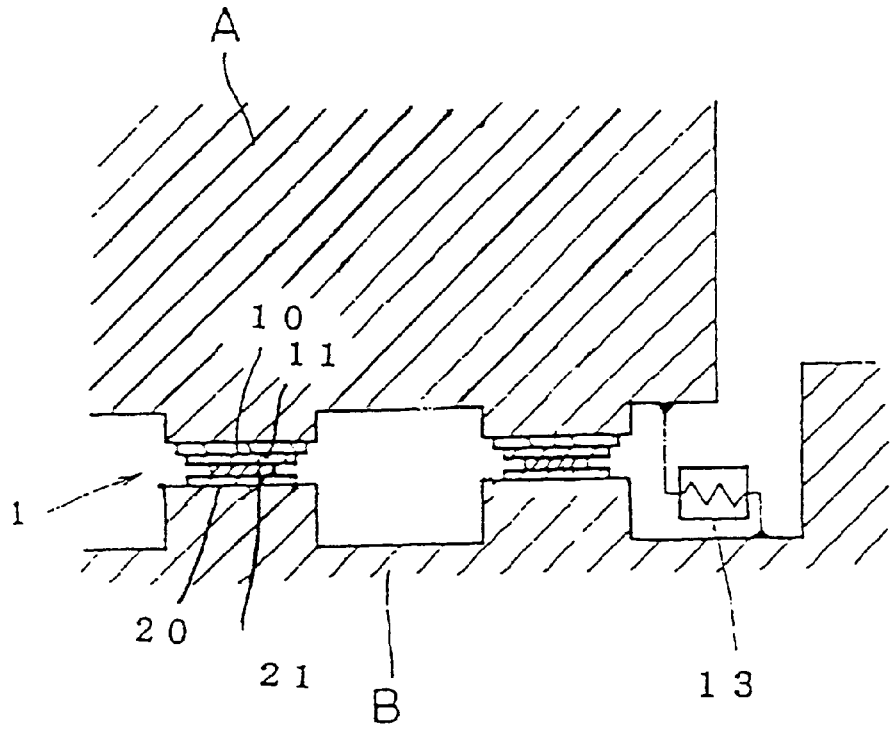
FIG. 1 is a sectional view of a seismic isolation sliding support bearing system according to an example of the invention.

A sliding bearing (a) used in a seismic isolation sliding support bearing system of this invention is made from a molding, having a porous structure with a plurality of micropores, of a composition including PTFE as a main component and aromatic polyester (PTFE composition), and a lubricant having a flow property (hereinafter referred to as the "flow lubricant") is held on the surface of the molding.

In the preparation of the sliding bearing (a), PTFE, aromatic polyester and, if necessary, a filler are mixed to obtain a PTFE composition. The PTFE composition is formed into a molding in the shape of a block through standard compression molding (including preforming, baking and cooling), and the thus-obtained molding is cut into a desired shape such as a plate. Thus, a molding with a porous structure including voids (micropores) can be obtained. A lubricant holding layer is formed by holding a flowable lubricant to be held in a surface portion of the molding. In this manner, the sliding bearing (a) used in the present seismic isolation sliding support bearing system can be fabricated. The treatment for holding the lubricant is preferably carried out under vacuum so that the lubricant can easily permeate into the voids.

Any polyester having an aromatic group can be used as the aromatic polyester included in the PTFE composition. An example is a p-hydroxybenzoic acid homopolymer. The aromatic polyester is included in the PTFE composition in a ratio of 14 through 35% by weight (wt %) and preferably 15 through 20 wt %. When the ratio of the aromatic polyester is smaller than 14 wt %, the compression elastic modulus of the resultant sliding bearing cannot be sufficiently increased, which degrades the reliability in the mechanical strength. Furthermore, in this case, the degree of porosity of the molding formed from the PTFE composition is so low that the lubricant cannot keep a sufficiently low coefficient of friction. On the other hand, when the ratio exceeds 35 wt %, the degree of porosity is so high that the mechanical strength of the resultant sliding bearing decreases so that the sliding bearing cannot be applied to a seismic isolation sliding support bearing system to which large loads (of, for example, 200 kgf/cm$^2$ or more) are applied.

The PTFE composition may further include a filler. Examples of the filler are graphite, glass fiber, molybdenum disulfide, potassium titanate and bronze. Except for the glass fiber, these materials are generally used in the form of a fine powder. One of these fillers can be used alone, or two or more of them can be used in combination. The filler is used for increasing the mechanical strength of or reducing the coefficient of friction of the resultant sliding bearing. The filler is preferably used in a ratio of 20 parts by weight or less, preferably 5 through 15 parts by weight, for 100 parts by weight of PTFE. Among the above-noted fillers, glass fiber is preferable with regard to improving the mechanical strength.

The PTFE composition is formed into a molding in the shape of a block by the compression molding (including preforming, baking and cooling) generally employed by those skilled in the art, and the obtained molding is cut into a desired shape such as a plate. Thus, a molding with a porous structure can be obtained.

Then, the flowable lubricant is held in the surface portion of the molding. Herein, the "surface portion" means not only the surface of the molding but also a porous structure portion extending from the surface to an internal layer into which the lubricant can permeate. Thus, the lubricant holding layer is formed in the surface portion of the molding. The lubricant can be applied onto the surface of the molding by a simple process such as coating or immersing. It has been confirmed that when the lubricant is thus applied, it permeates into a depth of at least 0.2 mm from the surface.

An example of the flowable lubricant is flowable polysiloxane. Herein, "flowable polysiloxane" means polysiloxane in the form of a liquid or wax. Polysiloxane in the form of a liquid has a comparatively low molecular weight, and examples are dimethylpolysiloxane, methylhydrogen polysiloxane and methylmethoxypolysiloxane. Polysiloxane in the form of wax has a slightly higher molecular weight than polysiloxane in the form of a liquid, and examples are dimethylpolysiloxane, methylphenylpolysiloxane, long-chain alkyl denatured silicone and trifluoropropylmethylpolysiloxane. One of these polysiloxanes can be used alone, or two or more of them can be used in combination.

In this manner, the sliding bearing (a) made from the molding including the lubricant holding layer for use in the present seismic isolation sliding support bearing system is obtained.

The sliding bearing (a) made from the molding having a porous structure for use in the present seismic isolation sliding support bearing system has sufficiently high mechanical strength, and can continuously maintain a low coefficient of friction for a long period of time even under application of a large load. This is probably for the following reason: The PTFE composition used in this invention includes PTFE as a main component and further includes an aromatic polyester in a specific ratio. Since an aromatic polyester is thus included in a specific ratio, the molding obtained from the composition can attain high mechanical strength, in particular a high compression elastic modulus (of approximately 900 MPa or more).

Furthermore, voids are formed in the molding in an appropriate ratio. This is probably due to compatibility between PTFE and the aromatic polyester. When the lubricant is applied to the molding, the lubricant permeates into the voids from the surface of the molding to be held therein. Therefore, the resultant sliding bearing (a) attains a very low coefficient of friction (of 0.017 through 0.020) owing to the sliding function of PTFE and the lubricant, and can maintain a low coefficient of friction for a long period of time.

Although conventional sliding bearings have a compression elastic modulus of approximately 460 MPa at most, the invention provides a sliding bearing (a) with a compression elastic modulus of 900 MPa or more and a very low coefficient of friction (of 0.017 through 0.020). The seismic isolation sliding support bearing system using this sliding bearing (a) attains an initial coefficient of friction of 0.02 or less in use under application of a surface pressure of 200 $kgf/cm^2$.

When the sliding bearing (a), which has also excellent mechanical strength, is used in a seismic isolation sliding support bearing system, the resin surface of the sliding bearing is suitably compressed under application of a large load at the initial stage of the sliding. As a result, the lubricant held within the voids flows out so as to be further supplied between the sliding bearings. Accordingly, a very low coefficient of friction can be attained. Furthermore, when the sliding is caused by an earthquake, even if the lubricant held on the surface of the sliding bearing (a) is lost from the space between the sliding bearings at the initial stage, the lubricant held within the voids formed in the internal portion can be continuously supplied to the surface of the sliding bearing, because the resin surface is randomly deformed due to the earthquake. Therefore, a low coefficient of friction can be constantly maintained. When the mechanical strength is insufficient under application of a large load, smooth sliding is not possible. Furthermore, even if the surface of the sliding bearing is abraded by the sliding during a long period of use, the voids containing the lubricant are successively exposed on the surface, so as to continuously supply the lubricant to be always present on the surface of the sliding bearing. Accordingly, when this sliding bearing is used in the seismic isolation sliding support bearing system of the invention, a very low coefficient of friction can be maintained for a long period of time. In other words, the lubricant is applied to the sliding bearing only once and there is no need to exchange the sliding bearing.

The seismic isolation sliding support bearing system of the invention may use a pair of sliding bearings (a) or a combination of the sliding bearing (a) and another sliding bearing. There is no particular limitation to the sliding bearing to be used in combination. In order to resist a load larger than a general load, a metallic plate (of stainless steel, carbon steel or the like) having a smooth face is occasionally used as the other sliding bearing. Preferred examples are a metallic base plate having a porous PTFE film on the surface thereof (hereinafter sometimes referred to as the sliding bearing (b)) and a metallic base plate having a PTFE film on the surface thereof (hereinafter sometimes referred to as the sliding bearing (c)).

The sliding bearing (b) includes a metallic base plate on which a porous resin film including PTFE as a main component is formed. Preferably, the porous PTFE film has appropriate strength, includes voids with a diameter of 10 through 100 $\mu$m, has a void area ratio (ratio occupied by the voids per unit area) of 10 through 50%, and includes, in the surface portion thereof, a lubricant holding layer where a flow lubricant is held.

The method of forming such a porous resin film is not particularly limited. For example, the porous film can be formed as follows: A composition including PTFE as a main component (PTFE composition) is mixed with a filler, the obtained mixture is formed into a molding by standard compression molding, the obtained molding is cut into a desired shape, and arranged on the metallic base plate. There is no particular limitation to the metal used for the metallic base plate, as long as it has appropriate strength and is difficult to oxidize. Examples are stainless steel and carbon steel Alternatively, the porous PTFE film can be obtained as follows: A mixture of a PTFE composition and a granular resin capable of forming an island structure (such as a resin without compatibility with the PTFE composition like polyethylene) is coated on the metallic base plate, and the granular resin is removed by heat decomposition or by dissolving it with a solvent.

In order to form a preferred porous PTFE film, one of the fillers that are commonly generally added to PTFE compositions may be added in a ratio of 20 through 30 wt % if necessary. The granular resin to be mixed with the PTFE composition has a size of 10 through 100 $\mu$m and preferably 10 through 20 $\mu$m, and is included in a ratio of 0.05 through 10 wt % and preferably 0.5 through 3 wt %.

The void area ratio is preferably approximately 10 through 50% and more preferably 15 through 40%. When the void area ratio is smaller than approximately 10%, it may be difficult to reduce the coefficient of friction, and when it exceeds approximately 50%, the strength of the resultant sliding bearing is degraded.

A flowable lubricant is preferably applied to the surface portion of the resin film. The lubricant can be applied by a simple process such as coating or immersing, and it permeates into the porous structure to be held within micropores (voids). The flowable lubricant used in the sliding bearing (b) is generally in the form of a liquid or wax, and examples are liquid paraffin, silicone oil, fluorine-containing oil, oleic acid, oleyl alcohol, and oleic acid ester.

The "surface portion" of the sliding bearing (b) includes not only the surface of the molding but also the porous structure portion in the vicinity of the surface into which the lubricant permeates, and the lubricant can be held in all the micropores of the resin film. Since the lubricant is thus held in the micropores of the resin film, it can be supplied between the sliding bearings for a long period of time, and the coefficient of friction can be further reduced.

The sliding bearing (b), which includes the porous PTFE film formed on the metallic base plate, has high strength and can be used in a wide range of fields including a seismic isolation sliding support bearing system for large structures such as buildings, bridges, and various industrial products. In this manner, the sliding bearing (b) is useful as an upper sliding bearing because of its low coefficient of friction.

The sliding bearing (c) (i.e., the metallic base plate having a PTFE film) can be obtained by dissolving PTFE in an appropriate solvent, applying the resulting solution to a metallic base plate and drying it.

If the sliding bearings are arranged in opposition and in contact with each other, one of the sliding bearings is preferably smaller than the other. If the sliding bearings are of the same size, a shift is caused between the sliding bearings when the sliding starts, and the load concentrates on the contact portion therebetween, so that the following problems can occur due to a large load: The sliding bearings are easily damaged; a constant coefficient of friction cannot be maintained because of non-uniform application of the load; and the edge of the metallic sliding bearing bites into the resin portion of the other sliding bearing and ruins the smooth sliding function, thereby damaging the sliding bearing and degrading the sliding function. When one of the sliding bearings has a smaller diameter than the other, the area for receiving a pressure is always constant, and hence, the aforementioned problems can be avoided. In this case, the lower sliding bearing is preferably smaller than the upper sliding bearing.

It is preferred that the sliding bearing (b) or (c) is used as the upper sliding bearing with the sliding bearing (a) used as the lower sliding bearing.

In the following, a seismic isolation sliding support bearing system using the sliding bearing (a) will be described.

FIG. 1 is a sectional view of a seismic isolation sliding support bearing system, corresponding to one example of the invention, for a building structure using the sliding bearing (a). The seismic isolation sliding support bearing system 1 includes an upper sliding bearing 11 disposed on an upper base plate 10 provided on a superstructure A, and a lower sliding bearing 21 disposed on a lower base plate 20 provided on a substructure B. The upper sliding bearing 11 and the lower sliding bearing 21 oppose and are in contact with each other, and can be moved relatively to each other.

The sliding bearing (a) of the invention is used at least for the upper sliding bearing 11 or the lower sliding bearing 21, or for both the upper and lower sliding bearings.

Preferably, the sliding bearing (a) is used for the lower sliding bearing 21, the sliding bearing (c) (i.e., the metallic base plate having the PTFE film) or the sliding bearing (b) (i.e., the metallic base plate having the porous PTFE film) is used for the upper sliding bearing 11, and the sliding bearing (a) has a smaller diameter than the sliding bearing (b) or (c). The seismic isolation sliding support bearing system having this structure can be subjected to a large load and can maintain a low coefficient of friction for a long period of time.

When an earthquake occurs, a horizontal load acts on the seismic isolation sliding support bearing system of FIG. 1, and relative displacement is caused between the upper sliding bearing 11 and the lower sliding bearing 21, resulting in seismic isolation. The seismic isolation sliding support bearing system of FIG. 1 includes a horizontal spring 13, so that the displaced superstructure A can be restored to its original position.

Figure 2:
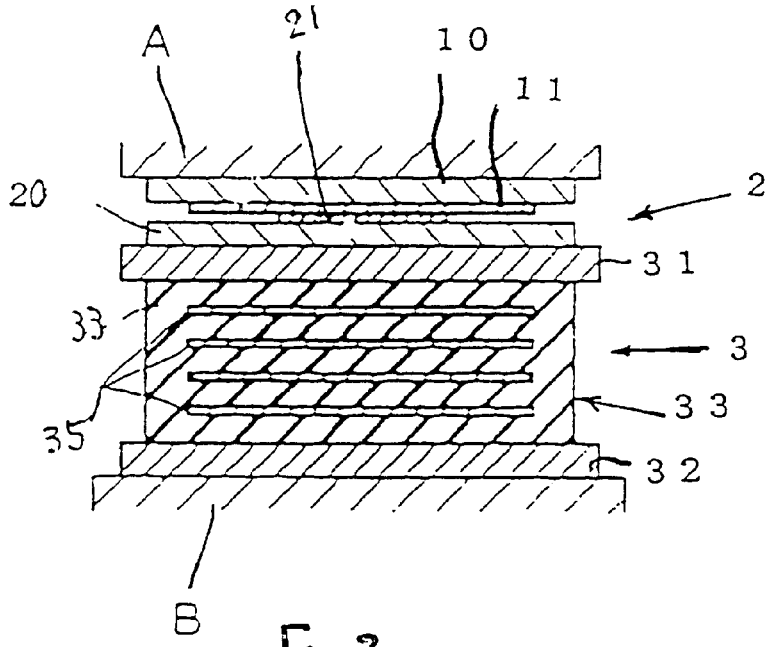
FIG. 2 is a sectional view of a seismic isolation sliding support bearing system according to another example of the invention.

FIG. 2 shows another example of the present seismic isolation sliding support bearing system. This sliding support bearing system includes a sliding support bearing 2 and a laminated rubber bearing 3 provided between a superstructure A and a substructure B. The sliding support bearing 2 includes an upper sliding bearing 11 disposed on an upper base plate 10, and a lower base plate 20 and a lower sliding bearing 21 disposed on a laminated rubber bearing upper base plate 31. The laminated rubber bearing 3 includes a laminated rubber layer 33 between the laminated rubber bearing upper base plate 31 and a laminated rubber bearing lower base plate 32. The laminated rubber layer 33 is formed by successively laminating plural rubber members 34 and metal plates 35. This seismic isolation sliding support bearing system ensures not only seismic isolation but also the restoration to a normal position due to the synergism of the sliding support bearing 2 using the sliding bearing (a) and the laminated rubber bearing 3.

EXAMPLES

The present invention will now be described on the basis of examples, which do not limit the invention. Preparation of sliding bearing (a):

PTFE, poly(p-hydroxybenzoic acid) and graphite with an average particle size of 44 $\mu$m are mixed in the ratios listed in Table 1 below, and a molding is obtained from the mixture by compression molding. The degree of porosity of the obtained molding is measured with electron microphotography. The result is shown in Table 1. The degree of porosity listed in Table 1 corresponds to the ratio occupied by micropores per unit area (void area ratio).

TABLE 1

| | Composition (wt %) | | | | Degree of |
|---|---|---|---|---|---|
| | PTFE | AP* | Graphite | Lubricant | porosity |
| Example 1 | 81 | 14 | 5 | silicone | 14 |
| Example 2 | 75 | 20 | 5 | silicone | 17 |
| Example 3 | 66 | 29 | 5 | silicone | 19 |
| Example 4 | 60 | 35 | 5 | silicone | 21 |
| Com. Ex. 1 | 83 | 12 | 5 | silicone | 5 |
| Com. Ex. 2 | 55 | 40 | 5 | silicone | 27 |
| Com. Ex. 3 | 66 | 29 | 5 | none | 19 |

*AP: aromatic polyester

To each of the obtained moldings, a silicone oil (manufactured by Shin-Etsu Silicone Co., Ltd.; Spray mold lubricant KP96SP) is applied. Thus, the sliding bearings of Examples 1 through 4 and Comparative Example 1 through 3 are obtained as test samples. Each test sample has a diameter of 12.7 mm.

Preparation of Sliding Bearing (b):

One hundred parts by weight of polyfron TFE enamel (manufactured by Daikin Industries, Ltd.; dispersant for coatings including tetrafluoroethylene resin as its main component) and 20 parts by weight of a polyethylene powder with an average particle size of 30 $\mu$m are mixed to obtain a suspension. The suspension is applied onto a base plate of stainless steel (SUS #800) with a thickness of 4 mm and dried so as to form a film with a thickness of 50 $\mu$m after drying. The thus-obtained resin film is heated at 390° C. for 30 minutes for decomposing the particles of the polyethylene powder, thereby forming a porous resin film. The area ratio of the pores is 18%. To the surface of the resin film, a silicone oil (manufactured by Shin-Etsu Silicone Co., Ltd.; Spray mold lubricant KP96SP) is applied. In this manner, the sliding bearing (b) is prepared.

Preparation of sliding bearing (c):

Polyfron TFE enamel is applied onto a base plate of stainless steel (SUS#800) with a thickness of 4 mm and dried, so as to form a film with a thickness of 50 $\mu$m after drying. In this manner, the sliding bearing (c) made from a metallic base plate coated with PTFE is prepared.

Examples 1 through 4 and Comparative Examples 1 through 3:

Each of the sliding bearings (a) (Examples 1 through 4 and Comparative Examples 1 through 3) prepared as described above is measured for the compression elastic modulus by the test method for testing the compression characteristics of plastic according to JIS K 7181. In the measurement, the initial load is a surface pressure of 0.2 MPa and the compression rate is 1.3 mm/min.

Next, a seismic isolation sliding support bearing system is constructed by combining each of the sliding bearings (a) of Examples 1 through 4 with the sliding bearing (b) or (c), and an initial coefficient of friction and an intermediate coefficient of friction thereof are measured.

Figure 3:
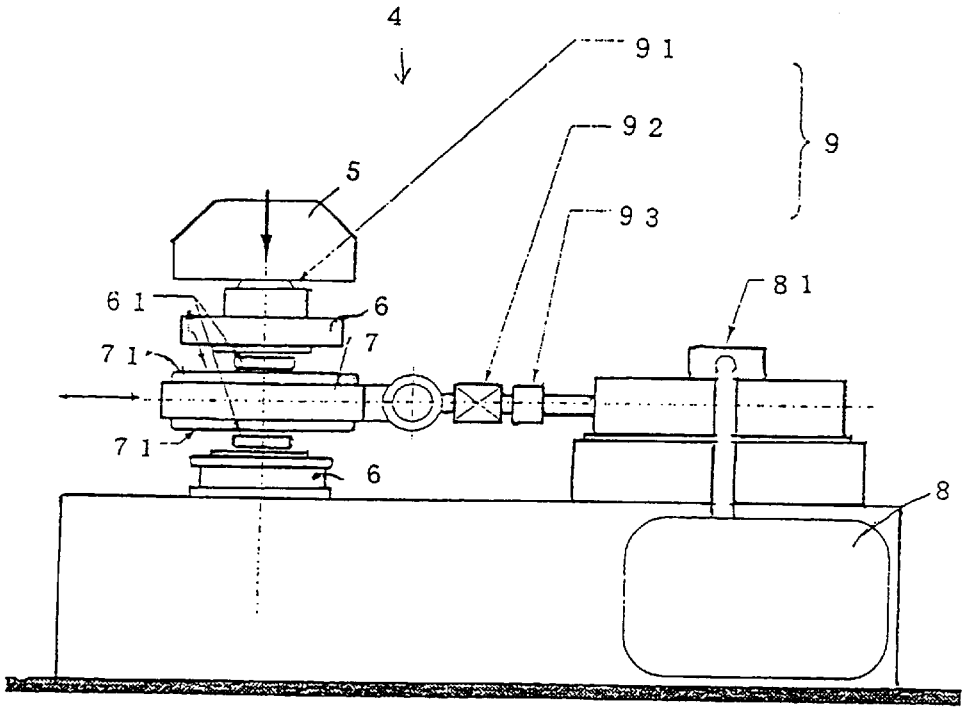
FIG. 3 is a schematic diagram of a reciprocating sliding test apparatus used for measuring a coefficient of friction of a sliding bearing.

The coefficient of friction is measured with a reciprocating sliding test apparatus 4 shown in FIG. 3. The test apparatus 4 includes a pressure device 5, upper and lower sample fixing parts 6, a movable plate 7, a hydraulic power source 8 and a recorder 9. The sliding bearing (a) 61 is fixed on each of the upper and lower sample fixing parts 6, and the sliding bearing (b) or (c) (shown with a reference numeral 71 in FIG. 3) is disposed on each surface of the movable plate 7. Then, a load of 70 ton force is applied by the pressure device 5. Power supplied by the hydraulic power source 8 is changed into predetermined reciprocation by an actuator 81, so as to reciprocate the movable plate 7. Thus, the sliding bearing (a) is slid on the sliding bearing (b) or (c). The experiments are carried out under a surface pressure load of 200 kgf/cm$^2$ and a rate of 20 cm/sec. From the measured values recorded by the recorder 9 after continuously sliding back and forth 10 and 300 times, the initial coefficient of friction and the intermediate coefficient of friction are calculated; respectively. The recorder 9 includes a load cell 91 for measuring pressure applied to the sliding bearing (a) 61, a load cell 92 for measuring the frictional reaction force and a displacement gauge 93 for measuring the displacement.

The thus-measured compression elastic module and coefficients of friction are listed in Table 2 below. Also, the relationship between the horizontal displacement and the coefficient of friction after sliding back and forth 10 times obtained by using the sliding bearing (a) of Example 3 and the sliding bearing (c) is shown in the chart in FIG. 4, and the same relationship obtained by using the sliding bearing of Comparative Example 3 is shown in the chart in FIG. 5, whereas the rate is 20 cm/sec. in FIG. 4 and 10 cm/sec. in FIG. 5. In Table 2, "SB1" indicates the sliding bearing (c) and "SB2" indicates the sliding bearing (b).

TABLE 2

| | Compression elastic modulus | Initial coefficient of friction (after sliding back and forth 10 times) | | Intermediate coefficient of friction (after sliding back and forth 300 times) | |
|---|---|---|---|---|---|
| | (MPa) | SB1 | SB2 | SB1 | SB2 |
| Example 1 | 910 | 0.020 | 0.017 | 0.034 | 0.030 |
| Example 2 | 920 | 0.018 | 0.015 | 0.036 | 0.032 |
| Example 3 | 980 | 0.015 | 0.013 | 0.028 | 0.023 |
| Example 4 | 900 | 0.014 | 0.012 | 0.030 | 0.026 |
| Com. Ex. 1 | 820 | 0.017 | 0.015 | 0.075 | 0.069 |
| Com. Ex. 2 | 780 | 0.017 | 0.015 | 0.030 | 0.028 |
| Com. Ex. 3 | 970 | 0.120 | 0.014 | 0.150 | 0.014 |

Figure 4:
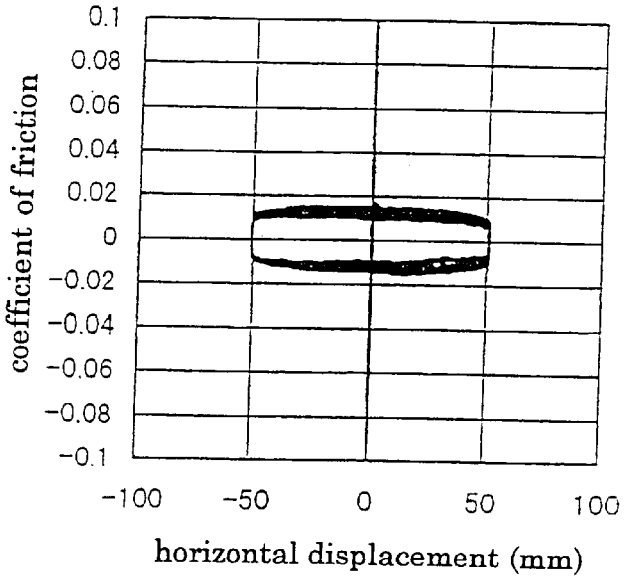
FIG. 4 is a chart of the coefficient of friction of a sliding bearing (a) used in the seismic isolation sliding support bearing system of this invention.
Figure 5:
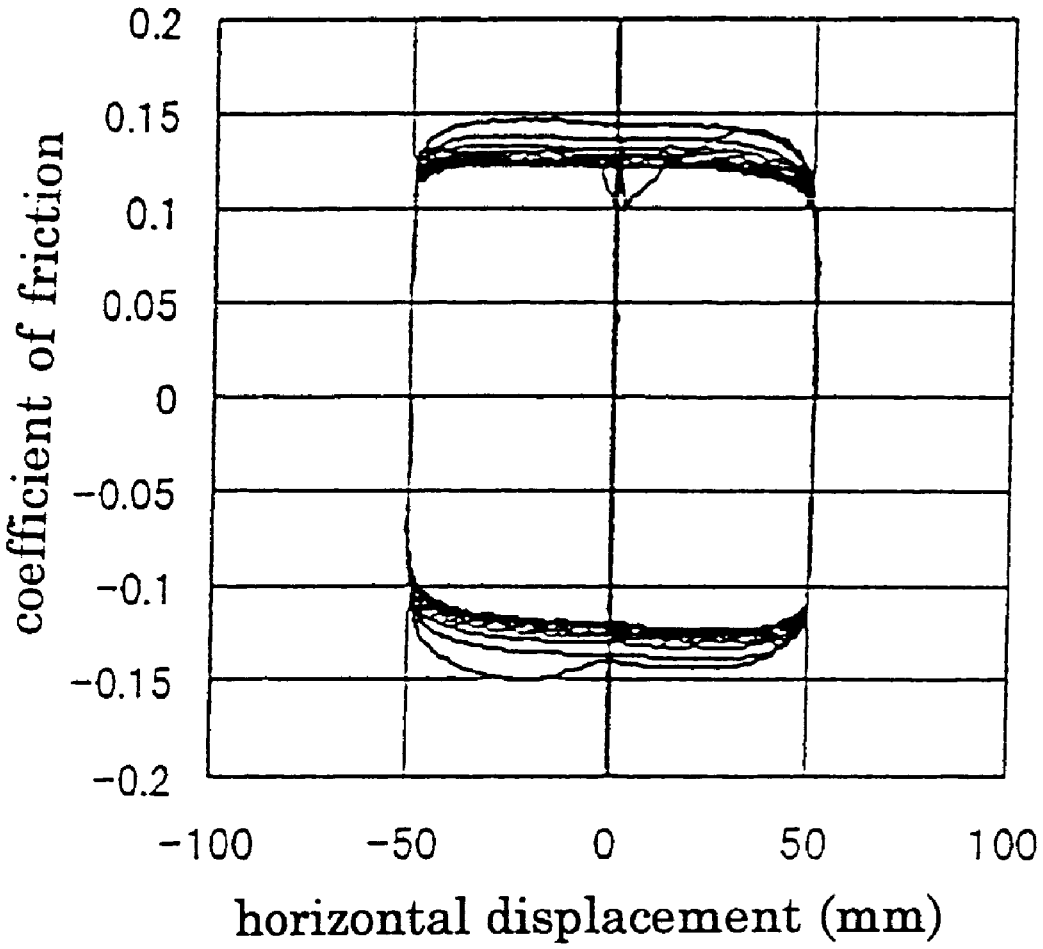
FIG. 5 is a chart of the coefficient of friction of a sliding bearing according to a comparative example.

As is obvious from Tables 1 and 2 and FIGS. 4 and 5, the seismic isolation sliding support bearing system using any of the sliding bearings (a) of the invention can attain a compression elastic modulus of 900 MPa or more and a very low initial coefficient of friction. Also, the intermediate coefficient of friction increases minimally increased from the initial coefficient of friction. The molding obtained in Comparative Example 1 has a low degree of porosity. Therefore, when this molding is used, although the initial coefficient of friction is low, the intermediate coefficient of friction tends to be large. The molding obtained in Comparative Example 2 has a low compression elastic modulus and poor mechanical strength. The molding obtained in Comparative Example 3 has a large initial coefficient of friction and a large intermediate coefficient of friction because no lubricant is applied.

What is claimed is:

1. A seismic isolation sliding support bearing system comprising a pair of sliding bearings relatively movably opposing and in contact with each other between a superstructure and a substructure, wherein at least one of the sliding bearings is a sliding bearing (a) made from a molding, having a porous structure including plural voids, of a composition including polytetrafluoroethylene resin as a main component and including aromatic polyester resin in a ratio of 14 through 35% by weight, and the molding includes, in a surface portion thereof, a lubricant holding layer where a flowable lubricant is held.

2. The seismic isolation sliding support bearing system according to claim 1, wherein the composition used for forming the sliding bearing (a) includes at least one filler selected from the group consisting of graphite, glass fiber, molybdenum disulfide, potassium titanate and bronze.

3. The seismic isolation sliding support bearing system according to claim 1, wherein the lubricant is flowable polysiloxane.

4. The seismic isolation sliding support bearing system according to claim 1, wherein the pair of sliding bearings are the sliding bearing (a) and a sliding bearing (b) made from a metallic base plate having, on a surface thereof, a resin film of a composition including polytetrafluoroethylene resin as a main component, and the resin film of the sliding bearing (b) includes micropores having a diameter of 10 through 100 $\mu$m in an area ratio of 10 through 50%, and includes, in a surface portion thereof, a lubricant holding layer where a flowable lubricant is held.

5. The seismic isolation sliding support bearing system according to claim 1, wherein one of the pair of sliding bearings is smaller than the other.

6. The seismic isolation sliding support bearing system according to claim 4, wherein the sliding bearing (a) is smaller than the sliding bearing (b).

7. The seismic isolation sliding support bearing system according to claim 1, wherein the seismic isolation sliding support bearing system has a coefficient of friction of 0.02 or less under a surface pressure of 200 kgf/cm$^2$.

* * * * *